US011272290B2

(12) United States Patent
Zhang et al.

(10) Patent No.: US 11,272,290 B2
(45) Date of Patent: Mar. 8, 2022

(54) SPEAKER MODULE AND ELECTRONIC DEVICE

(71) Applicant: GOERTEK INC., Shandong (CN)

(72) Inventors: Beijing Zhang, Shandong (CN); Fengchao Jia, Shandong (CN)

(73) Assignee: GOERTEK INC., Weifang (CN)

( * ) Notice: Subject to any disclaimer, the term of this patent is extended or adjusted under 35 U.S.C. 154(b) by 0 days.

(21) Appl. No.: 16/975,148

(22) PCT Filed: Dec. 24, 2018

(86) PCT No.: PCT/CN2018/123197
§ 371 (c)(1),
(2) Date: Aug. 24, 2020

(87) PCT Pub. No.: WO2019/161700
PCT Pub. Date: Aug. 29, 2019

(65) Prior Publication Data

US 2021/0120343 A1 Apr. 22, 2021

(30) Foreign Application Priority Data

Feb. 24, 2018 (CN) ..... 201810156798.7

(51) Int. Cl.
*H04R 1/28* (2006.01)
*H04R 9/06* (2006.01)
(Continued)

(52) U.S. Cl.
CPC ..... *H04R 9/06* (2013.01); *H04R 1/021* (2013.01); *H04R 1/025* (2013.01); *H04R 1/288* (2013.01);
(Continued)

(58) Field of Classification Search
CPC ..... H04R 1/021; H04R 1/023; H04R 1/025; H04R 1/2811; H04R 1/2826;
(Continued)

(56) References Cited

U.S. PATENT DOCUMENTS 9,838,765 B1 12/2017 Li et al.
2019/0215600 A1* 7/2019 Wang ..... H04R 1/025
(Continued)

FOREIGN PATENT DOCUMENTS

CN 106341770 A 1/2017
CN 106851498 A 6/2017
(Continued)

OTHER PUBLICATIONS

International Search Report from International Application No. PCT/CN2018/123197 dated Feb. 27, 2019.

*Primary Examiner* — Huyen D Le
(74) *Attorney, Agent, or Firm* — Brundidge & Stanger, P.C.

(57) ABSTRACT

Provided in an embodiment of the present disclosure are a speaker module and an electronic device. The speaker module includes a speaker unit and a module housing, the speaker unit is mounted in an inner cavity that is encircled by the module housing, and a closed rear acoustic cavity is formed between the speaker unit and the module housing; the speaker unit is provided thereon with a unit leakage holes which is in communication with the rear acoustic cavity, and an air-permeable separation element is fixed on the unit leakage holes; at least one porous material frame is disposed in the rear acoustic cavity; a region other than the porous material frame disposed in the rear acoustic cavity is filled with sound-absorbing particles. The technical solution provided by the present disclosure may reduce the resonance
(Continued)

frequency fluctuation range of the speaker, thereby improving the acoustic performance of the speaker module.

9 Claims, 4 Drawing Sheets

(51) Int. Cl.
*H04R 9/02* (2006.01)
*H04R 1/02* (2006.01)

(52) U.S. Cl.
CPC ..... *H04R 1/2811* (2013.01); *H04R 1/2826* (2013.01); *H04R 9/02* (2013.01); *H04R 2400/11* (2013.01); *H04R 2499/11* (2013.01)

(58) Field of Classification Search
CPC ..... H04R 1/2873; H04R 1/288; H04R 9/02; H04R 9/06; H04R 2201/029; H04R 2400/11; H04R 2499/11
See application file for complete search history.

(56) References Cited

U.S. PATENT DOCUMENTS

| | | | | |
|---|---|---|---|---|
| 2019/0253779 | A1* | 8/2019 | Zhang | H04R 1/025 |
| 2020/0204906 | A1* | 6/2020 | Shi | H04R 1/025 |

FOREIGN PATENT DOCUMENTS

| | | | |
|---|---|---|---|
| CN | 206341395 | U | 7/2017 |
| CN | 107071668 | A | 8/2017 |
| CN | 108235198 | A | 6/2018 |

* cited by examiner

SPEAKER MODULE AND ELECTRONIC DEVICE

TECHNICAL FIELD

The present disclosure belongs to the technical field of electro-acoustic conversion devices, particularly, the present disclosure relates to a speaker module and an electronic device.

BACKGROUND ART

A speaker is a device that can convert electric energy into acoustic energy, and is widely used in electronic devices such as mobile phones, computers, etc. When the speaker is assembled with a terminal device, it is usually necessary to place a speaker unit in an external housing and assemble them into the terminal device in the form of a module.

In the prior art, in order to improve the acoustic performance of the speaker module and improve the low-frequency loudness of the speaker module, sound-absorbing particles are filled in the limited rear acoustic cavity. Due to the fluidity of the sound-absorbing particles, when the sound-absorbing particles move freely in the rear acoustic cavity and appear in different positions, the lowest resonant frequency FO of the speaker will fluctuate, while the low-frequency loudness of the speaker module will be abnormal with the fluctuation of FO, and the consistency of frequency response curves corresponding to different directions is poor; that is, when the posture of the electronic device provided with the speaker module changes, the volume of the sound generated by the electronic device will also change, for example, it will fluctuate up and down, which may affect the sense of hearing and user experience.

SUMMARY

An object of the present disclosure is to reduce the fluctuation range of the resonant frequency of the speaker and improve the acoustic performance of the speaker module.

According to an aspect of the present disclosure, a speaker module is provided. The speaker module comprises a speaker unit and a module housing, the speaker unit is mounted in an inner cavity surrounded by the module housing, a closed rear acoustic cavity is formed between the speaker unit and the module housing, a unit leakage hole which is in communication with the rear acoustic cavity is provided on the speaker unit, an air-permeable separation element is fixed on the unit leakage hole, at least one porous material frame is provided in the rear acoustic cavity, and sound-absorbing particles are filled in a region other than the porous material frame in the rear acoustic cavity.

Optionally, the porous material frame comprises at least one first porous material frame distributed at a position close to the unit leakage hole.

Optionally, the porous material frame comprises at least one second porous material frame distributed at a cavity end portion of the rear acoustic cavity far away from the speaker unit.

Optionally, the porous material frame further comprises at least one third porous material frame provided at a cavity middle portion of the rear acoustic cavity adjacent to the cavity end portion.

Optionally, the porous material frame is made of sound-absorbing cotton.

Optionally, a mounting structure for mounting the speaker unit is provided in the module housing, and at least one first porous material frame is provided close to an outer side of the mounting structure.

Optionally, the speaker unit has a rectangular shape, and two adjacent corners of a bottom surface of the speaker unit are respectively provided with the unit leakage hole.

Optionally, the speaker unit has a rectangular shape, and a side surface of the speaker unit is provided with the unit leakage hole.

Optionally, a filling opening for filling the sound-absorbing particles is provided on the module housing at a position opposite to the rear acoustic cavity, and the filling opening is covered by a sealing element.

According to another aspect of the present disclosure, an electronic device is provided. The electronic device comprises the above speaker module.

In the technical solution provided by the embodiments of the present disclosure, by providing the porous material frame in the rear acoustic cavity of the speaker module, the movement space of the sound-absorbing particles can be reduced, thus limiting the distribution position of the sound-absorbing particles to a certain extent, and reducing the fluctuation range of resonance frequency caused by the free movement of the sound-absorbing particles in the rear acoustic cavity.

Other features and advantages of the present disclosure will become clear by the following detailed description of exemplary embodiments of the present disclosure with reference to the accompanying drawings.

BRIEF DESCRIPTION OF THE DRAWINGS

The drawings constituting a part of the specification describe the embodiments of the present disclosure and are used to explain the principles of the present disclosure together with the description.

DETAILED DESCRIPTION OF THE EMBODIMENTS

Figure 1:
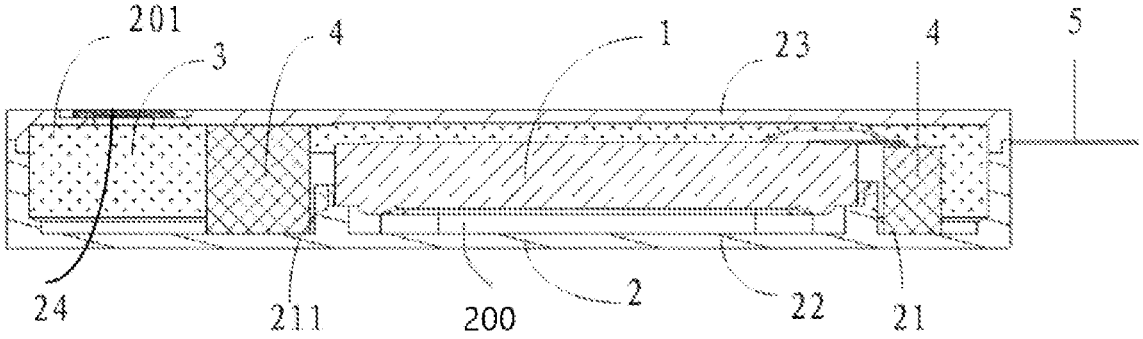
FIG. 1 is a sectional view of the speaker module provided by an embodiment of the present disclosure.

Various exemplary embodiments of the present disclosure will now be described in detail with reference to the accompanying drawings. It should be noted that the relative arrangement, numerical expressions and numerical values of the components and steps described in these embodiments do not limit the scope of the present disclosure, unless otherwise specified.

The following description of at least one exemplary embodiment is in fact illustrative only and in no way serves as any limitation to the present disclosure and its application or use.

The techniques and equipment known to those skilled in the art may not be discussed in detail, however, the techniques and equipment should be considered as a part of the specification as appropriate.

In all examples shown and discussed here, any specific value should be interpreted as only exemplary rather than as a limitation. Therefore, other examples of exemplary embodiments may have different values.

It should be noted that similar reference numerals and letters indicate similar items in the following drawings, therefore, once an item is defined in one drawing, further discussion on the item is not necessary in the subsequent drawings.

Figure 2:
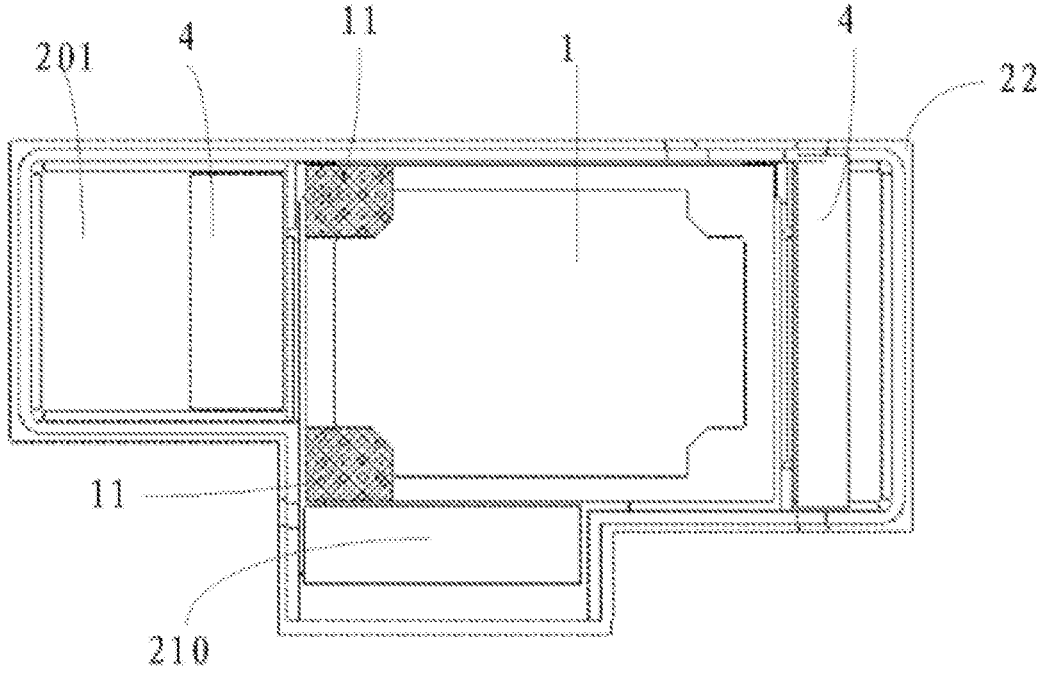
FIG. 2 is an internal structure diagram of the speaker module provided by an embodiment of the present disclosure.

FIG. 1 is a sectional view of the speaker module provided by an embodiment of the present disclosure. As shown in FIG. 1, the speaker module comprises a speaker unit 1 and a module housing 2, the speaker unit 1 is mounted in an inner cavity surrounded by the module housing 2, a closed rear acoustic cavity 201 is formed between the speaker unit 1 and the module housing 2, a unit leakage hole (not shown) which is in communication with the rear acoustic cavity 201 is provided on the speaker unit 1, an air-permeable separation element 11 (as shown in FIG. 2) is fixed on the unit leakage hole, at least one porous material frame is provided in the rear acoustic cavity 201, and sound-absorbing particles 3 are filled in a region other than the porous material frame in the rear acoustic cavity 201.

Wherein, the air-permeable separation element comprises but is not limited to mesh cloth and metal corrosion resistant mesh. The air-permeable separation element covers at the unit leakage hole, which may prevent the sound-absorbing particles in the rear acoustic cavity from entering the magnetic circuit system in the speaker unit, furthermore, the air flow between the interior of the speaker unit and the rear acoustic cavity will not be affected due to the existence of pores in the air-permeable separation element.

The porous material frame comprises but is not limited to sound-absorbing cotton, porous ceramics, foam plastic and foam glass. The porous material frame is provided in the rear acoustic cavity 201, which may effectively reduce the movement space of the sound-absorbing particles, thus limiting the flow of the sound-absorbing particles 3, so as to reduce the fluctuation range of resonance frequency. Because the porous structure in the porous material frame may ensure the permeability of the air flow, it will not affect the space volume of the air flow in the rear acoustic cavity. The space in the rear acoustic cavity not occupied by the porous material frame is the movement space of the sound-absorbing particles 3.

In the technical solution provided by the embodiments of the present disclosure, the movement space of the sound-absorbing particles may be reduced by providing the porous material frame in the rear acoustic cavity of the speaker module, so as to limit the distribution positions of the sound-absorbing particles to a certain extent, and reduce the fluctuation range of resonance frequency caused by the free movement of the sound-absorbing particles in the rear acoustic cavity.

In a realizable solution, the porous material frame is made of sound-absorbing cotton. As the sound-absorbing cotton itself has sound-absorbing effect, the porous material frame can reduce the usage amount of the sound-absorbing particles while play the above-mentioned role, thus reducing the cost. In addition, when the sound-absorbing cotton is filled in the speaker module, the cushioning effect of the sound-absorbing cotton plays a role in protecting the sound-absorbing particles, so that the crush problem in the Micro-Drop test for reliability of the speaker module is improved to a certain extent.

Further, the porous material frame may be provided at a position close to the leakage hole of the speaker unit, such that the number of the sound-absorbing particles near the unit leakage hole may be further reduced, so as to avoid the problem of decrease of the quality factor Q value of the speaker caused by the accumulation of a large number of sound-absorbing particles around the unit leakage hole. In a specific implementation, as shown in FIG. 1, the porous material frame comprises at least one first porous material frame 4 distributed at a position close to the unit leakage hole.

In a specific implementation, considering the complexity of the structure of the rear acoustic cavity of the speaker module, when the first porous material frame is provided in the rear acoustic cavity, the first porous material frame not only needs to be provided close to the unit leakage hole, but also needs to be designed in combination with the internal structure of the rear acoustic cavity. For example, as shown in FIG. 1, a mounting structure 21 for mounting the speaker unit 1 is provided in the module housing 2, and the first porous material frame 4 is provided close to the outer side of the mounting structure 21. Providing the first porous material frame 4 close to the outer side of the mounting structure 21 may effectively reduce the space around the speaker unit 1 that can be used for accommodating the sound-absorbing particles 3.

In a realizable structure, the module housing 2 comprises a first housing 22 and a second housing 23 covered on the first housing 22, the mounting structure 21 comprises a mounting wall 211 extending from the bottom wall of the first housing 22 to the second housing 23, the extended end of the mounting wall 211 is provided with a step surface, and the speaker unit 1 is fixed on the step surface. The outer side of the mounting wall 211 is located in the rear acoustic cavity 201, and the first porous material frame 4 is provided close to the outer side of the mounting wall 211. In this way, the first porous material frame 4 is provided as close as possible to the unit leakage hole on the speaker unit 1.

Furthermore, in addition to filling a large volume of porous material frame at a position near the unit leakage hole in the rear acoustic cavity 201, a larger volume of porous material frame may be filled at an end of the speaker module to avoid the problem of reduction of the sound-absorbing effect caused by the sound-absorbing particles 3 being too far away from the unit 1. Specifically, in the speaker module provided by an embodiment of the present disclosure, the porous material frame comprises at least one second porous material frame (not shown) distributed at a cavity end portion of the rear acoustic cavity 201 far away from the speaker unit 1. This may effectively prevent a large number of sound-absorbing particles from accumulating at the end of the module, which improves the matter that FO exceeds the limited range after the reliability test of the speaker module.

Furthermore, in the speaker module provided by an embodiment of the present disclosure, the porous material frame further comprises at least one third porous material frame (not shown) provided at the cavity middle portion of the rear acoustic cavity 201 adjacent to the cavity end portion. Providing the porous material frame at the cavity middle portion may also effectively reduce the movement space of the sound-absorbing particles.

It should be noted that whether or not to provide the third porous material frame may be determined according to the size of the speaker module, acoustic performance design requirements and other factors.

In a specific implementation, the volume of the above first porous material frame may be larger than the volume of the third porous material frame, and the volume of the second porous material frame may be larger than the volume of the third porous material frame.

The position of the unit leakage hole on the speaker unit may be designed according to the actual structure of the speaker unit and the actual position of the rear acoustic cavity, which is not specifically limited in the present disclosure. In a realizable solution, the speaker unit 1 has a rectangular shape, and two adjacent corners of the bottom surface of the speaker unit 1 are respectively provided with the unit leakage hole (see FIG. 2, the position covered by the air-permeable separation element 11 is the position of the unit leakage hole). As shown in FIG. 2, the two adjacent corners are located at a short side of the bottom surface of the speaker unit 1. In another realizable solution, the speaker unit 1 has a rectangular shape, and a side surface of the speaker unit 1 is provided with the unit leakage hole.

Figure 3:
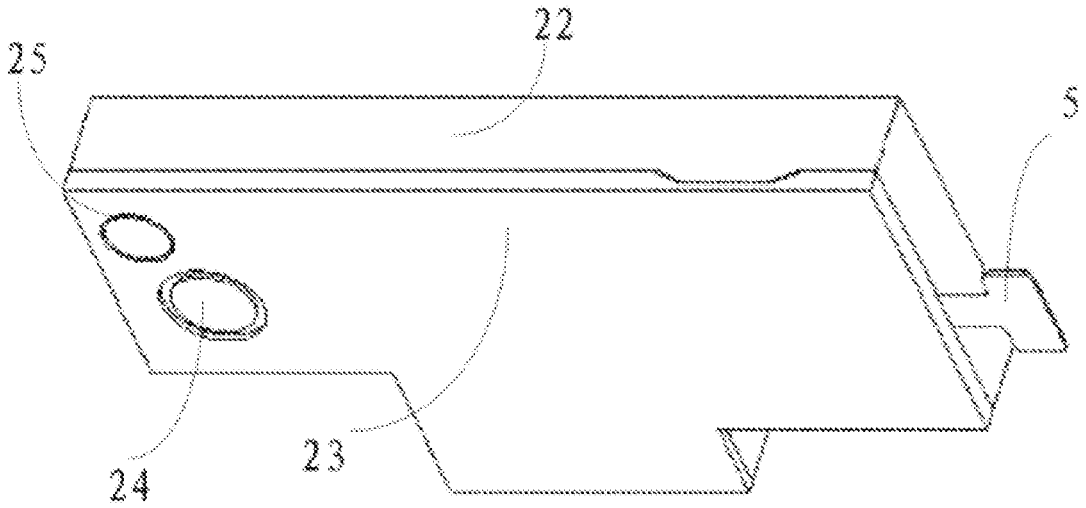
FIG. 3 is a schematic structure diagram of the speaker module provided by an embodiment of the present disclosure in a first viewing direction.
Figure 4:
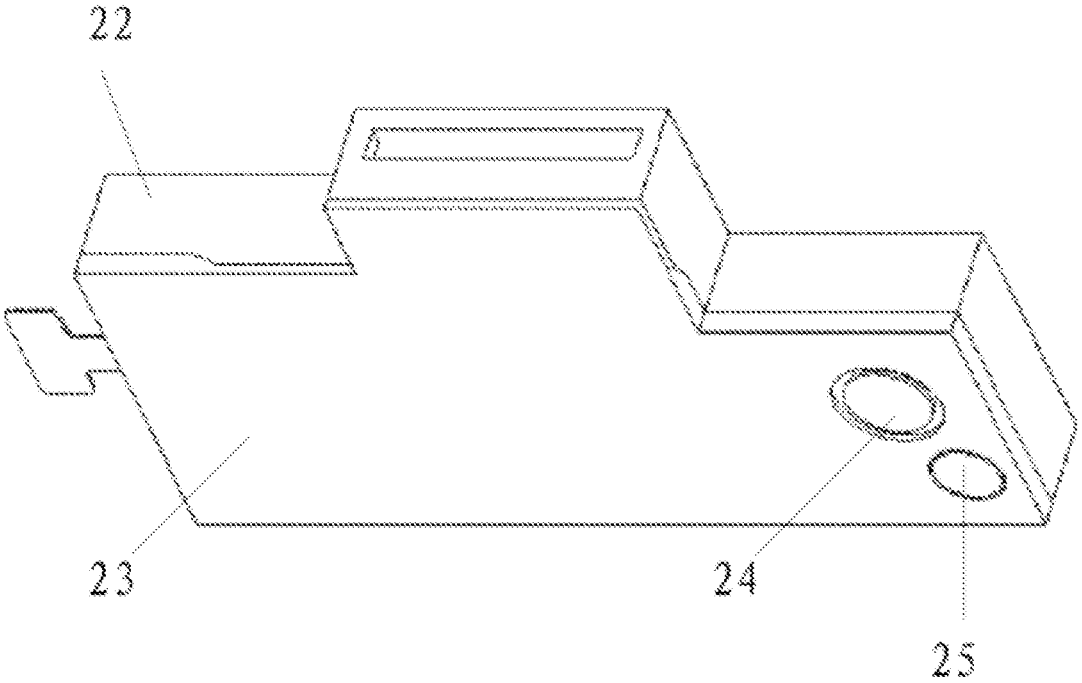
FIG. 4 is a schematic structure diagram of the speaker module provided by an embodiment of the present disclosure in a second viewing direction.

Further, as shown in FIG. 3 and FIG. 4, a filling opening for filling the sound-absorbing particles is provided on the module housing 2 at a position opposite to the rear acoustic cavity 201, and the filling opening is covered by a sealing element 24. The filling opening is provided to facilitate the filling operation of the sound-absorbing particles 3.

Further, a module leakage hole 25 is provided on the module housing 2 at a position opposite to the rear acoustic cavity 201, and the module leakage hole 25 is covered by a damping film. Since the air in the rear acoustic cavity may be compressed or expanded, the module leakage hole 25 provided on the module housing 2 may facilitate the air circulation, so as to balance the air pressure inside and outside the speaker module. The acoustic resistance of the module leakage hole may be increased by covering the damping film at the module leakage hole to reduce the impact of the module leakage hole on the acoustic performance. The damping film comprises but is not limited to mesh cloth.

In order to improve the high frequency performance of the speaker module, sound-absorbing cotton may be provided in a sound channel of the speaker module. Specifically, as shown in FIG. 2, the speaker module is provided with a sound channel penetrating the side wall of the module housing 1, the sound channel is in communication with the front acoustic cavity 200, and the sound-absorbing cotton 210 is provided in the sound channel.

Figure 5:
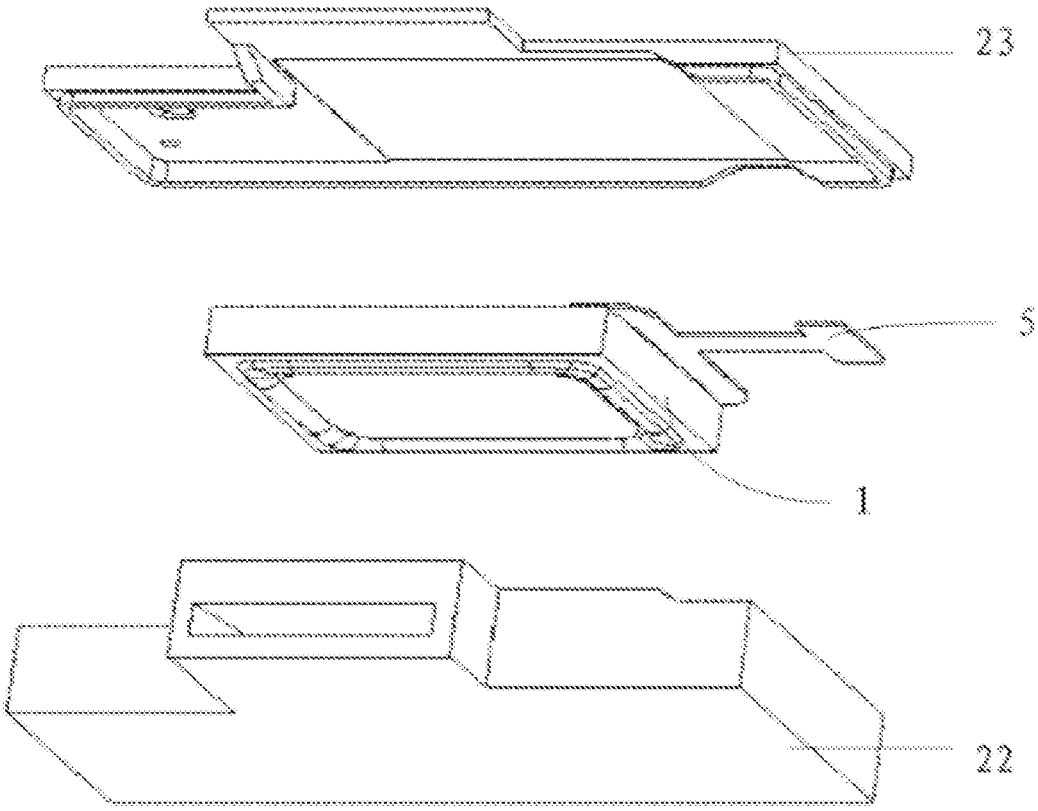
FIG. 5 is an exploded view of the speaker module provided by an embodiment of the present disclosure.
Figure 6:
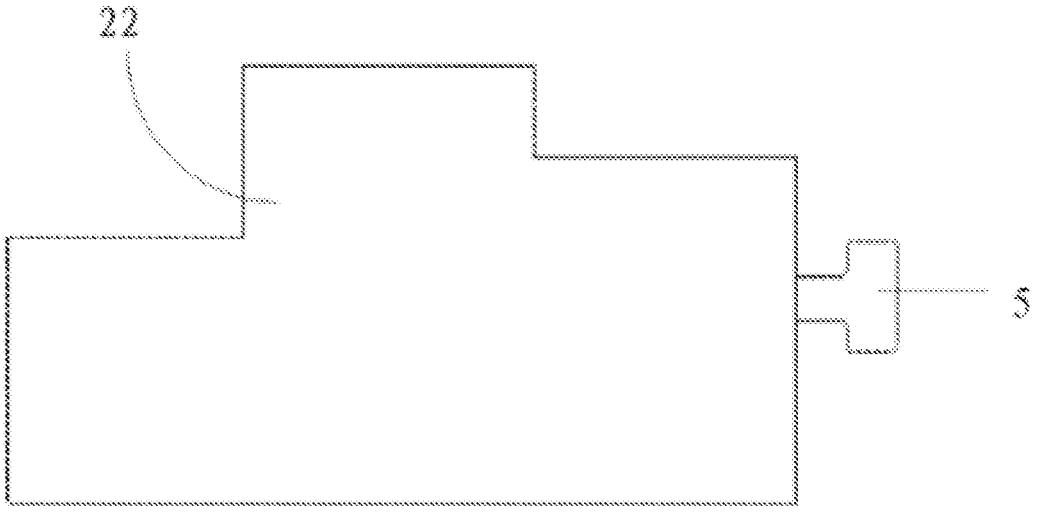
FIG. 6 is a schematic structure diagram of the speaker module provided by an embodiment of the present disclosure in a third viewing direction.

In a specific implementation, as shown in FIG. 1, FIG. 5 and FIG. 6, the speaker module may further comprise a flexible circuit board 5, one end of the flexible circuit board 5 extends into the module housing 2 and is electrically connected with the speaker unit 1, and the other end of the flexible circuit board 5 extends out of the module housing 2. The external circuit is electrically connected with the speaker unit 1 through the other end extending out of the module housing 2. According to another aspect of the present disclosure, an electronic device is further provided, and the electronic device comprises the speaker module. Wherein, the specific implementation of the speaker module may refer to the relevant contents in the above-mentioned embodiments, and will not be repeated here.

The electronic device comprises but is not limited to mobile phone, tablet computer, MP3, etc.

Although some specific embodiments of the present disclosure have been described in detail by way of examples, it should be understood by those skilled in the art that the above examples are for illustrative purposes only and are not intended to limit the scope of the present disclosure. It should be understood by those skilled in the art that the above embodiments can be modified without departing from the scope and spirit of the present disclosure. The scope of the present disclosure is defined by the appended claims.

What is claimed is:

1. A speaker module, comprising:

a speaker unit and a module housing, wherein;

the speaker unit is mounted in an inner cavity surrounded by the module housing, and a closed rear acoustic cavity is formed between the speaker unit and the module housing;

a unit leakage hole which is in communication with the closed rear acoustic cavity is provided on the speaker unit, and an air-permeable separation element is fixed on the unit leakage hole;

at least one porous material frame is provided in the closed rear acoustic cavity;

sound-absorbing particles are filled in a region other than the at least one porous material frame in the closed rear acoustic cavity; and the at least one porous material frame includes a first porous material frame distributed at a position close to the unit leakage hole.

2. The speaker module according to claim 1, wherein the at least one porous material frame comprises a second porous material frame distributed at a cavity end portion of the closed rear acoustic cavity far away from the speaker unit.

3. The speaker module according to claim 2, wherein the at least one porous material frame further comprises a third porous material frame provided at a cavity middle portion of the closed rear acoustic cavity adjacent to the cavity end portion.

4. The speaker module according to claim 1, wherein the at least one porous material frame is made of sound-absorbing cotton.

5. The speaker module according to claim 1, wherein a mounting structure for mounting the speaker unit is provided in the module housing, and the first porous material frame is provided close to an outer side of the mounting structure.

6. The speaker module according to claim 1, wherein the speaker unit has a rectangular shape, and two adjacent corners of a bottom surface of the speaker unit are respectively provided with the unit leakage hole.

7. The speaker module according to claim 1, wherein the speaker unit has a rectangular shape, and a side surface of the speaker unit is provided with the unit leakage hole.

8. The speaker module according to claim 1, wherein a filling opening for filling the sound-absorbing particles is provided on the module housing at a position opposite to the rear acoustic cavity, and the filling opening is covered by a sealing element.

9. An electronic device, comprising the speaker module according to claim 1.

* * * * *